United States Patent [19]

Maslakov et al.

[11] Patent Number: 4,739,837

[45] Date of Patent: Apr. 26, 1988

[54] PNEUMATIC IMPACT TOOL

[76] Inventors: Petr A. Maslakov, Ulitsa Nikitina, 70, kv. 131; Nikolai A. Klushin, Krasny prospekt, 56, kv. 53; Vladimir I. Kokarev, ulitsa Kropotkina, 118, kv. 421, all of Novosibirsk; Boris G. Goldshtein, ulitsa Molodogvardeiskaya, 24, korpus 1, kv. 26; Igor V. Nikolaev, ulitsa Fadeeva, 5, kv. 37, both of Moscow, all of U.S.S.R.

[21] Appl. No.: 839,810

[22] Filed: Mar. 12, 1986

Related U.S. Application Data

[63] Continuation of Ser. No. 576,117, Feb. 2, 1984, abandoned.

[30] Foreign Application Priority Data

Apr. 22, 1983 [SU] U.S.S.R. ..... 3576601
May 30, 1983 [SU] U.S.S.R. ..... 3596701

[51] Int. Cl.[4] ..... B25D 17/12

[52] U.S. Cl. ..... 173/135; 173/DIG. 2; 181/230; 181/254

[58] Field of Search ..... 173/135, 139, DIG. 2; 181/230, 254, 278, 227, 206

[56] References Cited

U.S. PATENT DOCUMENTS

| | | | |
|---|---|---|---|
| 3,223,181 | 12/1965 | Price | 173/DIG. 2 |
| 3,554,316 | 1/1971 | Judd | 173/DIG. 2 |
| 3,635,299 | 1/1972 | Hayes | 173/DIG. 2 |
| 4,189,971 | 2/1980 | Gunning | 173/DIG. 2 |

FOREIGN PATENT DOCUMENTS

| | | | |
|---|---|---|---|
| 1299578 | 7/1969 | Fed. Rep. of Germany . | |
| 1503156 | 1/1970 | Fed. Rep. of Germany | 181/230 |
| 192423 | 11/1964 | Sweden . | |

*Primary Examiner*—E. R. Kazenske
*Assistant Examiner*—Hien H. Phan
*Attorney, Agent, or Firm*—Ladas & Parry

[57] ABSTRACT

A pneumatic impact tool comprising a casing having an interior space in which is mounted a piston for reciprocations under the action of compressed air for delivering useful blows, and ports of at least two exhaust passages opening into the interior space, one of the exhaust passages permanently communicating with atmosphere and the other with a chamber for preliminarily reducing the exhaust pressure. The chamber for preliminarily reducing the exhaust pressure is permanently connected through at least one passage to the exhaust passage communicating with atmosphere.

2 Claims, 2 Drawing Sheets

PNEUMATIC IMPACT TOOL

This is a continuation of co-pending application Ser. No. 576,117, filed on Feb. 2, 1984, now abandoned.

PNEUMATIC IMPACT TOOL

The invention relates to pneumatic impact tools.

The invention may be most advantageously used in portable pneumatic impact tools designed for various purposes such as chipping and rivetting hammers, pick hammers, concrete breakers, tampers, and the like. The invention may be used in the most efficient manner in portable small-size pneumatic impact tools.

Impact tools working with a supply from a compressed air source have a number of undoubted advantages over similar tools supplied with other kinds of energy (electrical, hydraulic, and the like) and this is why such tools have found a widespread application is practice (simplicity of structure, high reliability in operation, easy maintenance, and the like). However, a peculiar disadvantage inherent in such tool is well-known: this is an aerodynamic noise of substantial intensity, and the effect of such noise on the operating personnel and surrounding population may result in harmful consequences such as occupational diseases and lower labour productivity. The causes of such noise are also known and they mainly reside in a high pressure of exhaust air and high turbulence of the air flow emerging from a tool into atmosphere.

Attempts to reduce aerodynamic noise of pneumatic impact tools are known.

One such attempt of reducing the aerodynamic noise was based on a more gradual beginning of air exhaust. This concept was used in a pneumatic impact tool (cf. Swedish patent No. 192423, Cl. 87a 2/20, 05.16.58), comprising a casing having an interior space, a piston mounted for reciprocations under the action of compressed air and for delivering useful blows, and an exhaust duct for discharging exhaust air from the interior space of the casing into atmosphere, the exhaust duct comprising main exhaust passages and auxiliary exhaust passages extending above and under the main passages. The total cross-sectional area of the auxiliary exhaust passages is substantially smaller than the total cross-sectional area of the main exhaust passages.

Inspite of the more gradual beginning of the exhaust cycle, the aerodynamic noise in this tool remained rather high owing to a high exhaust pressure and strong turbulence of the flow of exhaust air.

Known in the art are attempts to lower the aerodynamic noise by using mufflers of various types. Such concept was used in a pneumatic impact tool (cf. FRG patent No. 1503156, Cl. 87b 2/20, 04.0.1.65), comprising a casing having an interior space, a piston mounted in the interior space for reciprocations under the action of compressed air and for delivering useful blows, exhaust passages and a muffler installed on the casing, the interior space of the muffler communicating with the exhaust passages and directly with atmosphere.

The provision of a muffler, however, makes the tool bulky and liable to damages, which is especially inacceptable for portable tools, in particular when they are of a small size.

Attempts are also known to lower the aerodynamic noise by reducing the exhaust pressure value to a more substantial extent. This concept was used in a pneumatic impact tool (cf. FRG Patent No. 1299578, Cl. 87b 2/20, .0617.69), comprising a casing having an interior space, a piston mounted in the interior for reciprocations under the action of compressed air and for delivering useful blows, at least one exhaust passage for discharging exhaust air from the interior space of the casing into atmosphere, a chamber communicating with the interior space of the casing through at least one passage, said chamber being designed for preliminarily reducing the exhaust pressure. This is the prior art tool.

The noise in this prior art tool is still rather high owing to a strong turbulence of exhaust air.

It is an object of the invention to lower the aerodynamic noise.

Another object of the invention is to improve the labour productivity.

With these and other objects in view, the invention provides a pneumatic impact tool, comprising a casing having an interior space accommodating a piston which is adapted to reciprocate under the action of compressed air for delivering useful blows, the inner space having ports of at least two exhaust passages, one exhaust passage communicating with atmosphere and the other with a chamber designed for preliminarily reducing the exhaust pressure, wherein, according to the invention, the chamber for preliminarily reducing the exhaust pressure is permanently connected through at least one passage to the exhaust passage communicating with atmosphere.

The flow of exhaust air in this impact tool is divided into two flows which are then again united into a single flow. At the point of their merger (turbulizing point) an intense stirring occurs thus bringing about a further lowering of the aerodynamic noise owing to a lower turbulence of air emerging from the tool.

A non-return valve is preferably provided in the exhaust passage connecting the interior space of the casing to the chamber designed for preliminarily reducing the exhaust pressure.

This facility makes it possible to prevent backward overflow of exhaust air from the chamber designed for preliminarily reducing the exhaust pressure back to the interior of the casing thus contributing to a more clear-cut splitting of the exhaust air into two flows which, in the end, contributes to a more intense stirring of the flows and more effective lowering of the aerodynamic noise.

It also preferred that the position of the ports of the exhaust passages and the point at which the exhaust passages communicating with atmosphere are connected to the passages permanently communicating with the chamber for preliminarily reducing the exhaust pressure should be chosen in such a mnner as to provide for a substantially simultaneous arrival of exhaust air at this point.

This is the most optimum way for achieving maximum result in lowering the aerodynamic noise.

It is also preferred to provide a pneumatic impact tool with a housing installed on the casing, and to define the chamber for preliminarily reducing the exhaust pressure between the end faces of the casing and housing.

This construction of the pneumatic impact tool makes it possible to lower the aerodynamic noise simultaneously with reduction of vibrations.

The casing is preferably of a stepped configuration in its upper part, and the small-diameter step of the casing is received in the chamber designed for preliminarily reducing the exhaust pressure, the exhaust passage communicating this chamber with the interior space of the casing terminating in the end face of the large-diameter step which forms a seat of the non-return valve having its valve member in the form of a flat ring mounted for a limited axial movement on the small-diameter step of the casing.

This construction greatly simplifies the design of the pneumatic impact tool.

The pneumatic impact tool according to the invention provides for a substantial lowering of the aerodynamic noise and also for reduction of vibrations while being comparatively simple in structure.

The invention will now be described with reference to specific embodiments illustrated in the accompanying drawings in which:

FIG. 1 schematically shows a longitudinal section of a pneumatic impact tool according to the invention;

FIG. 2 schematically shows a longitudinal section of a pneumatic impact tool according to the invention with a chamber defined between the casing and housing;

Figure 1:
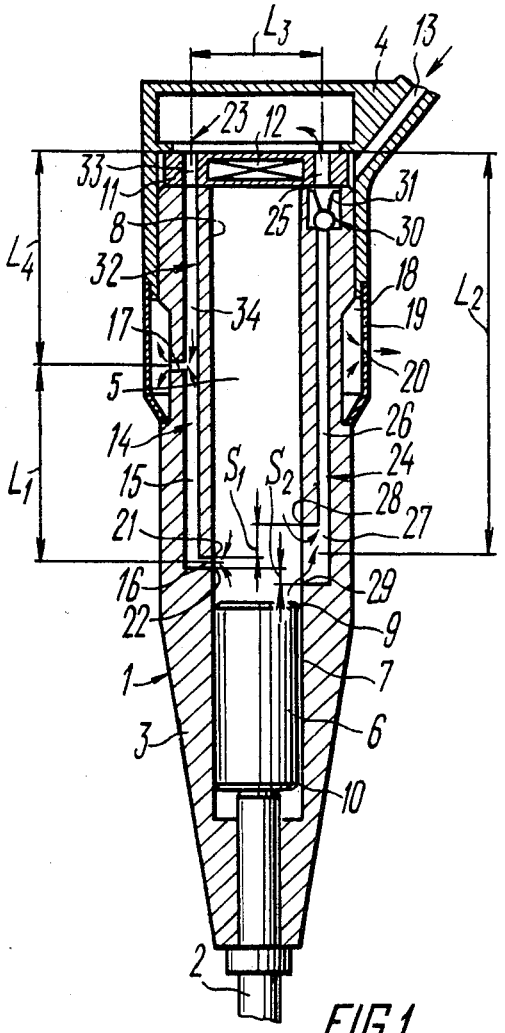

The invention will be described with reference to its specific embodiments which do not, however, restrict the spirit and scope of the invention.

A pneumatic impact tool such as a portable hammer (chipping, rivetting, pick hammer, and the like) has a casing 1 (FIG. 1) and a working tool 2 (such as chisel, pick or the like) which is inserted in the lower part of the pneumatic tool.

The casing 1 consists of a barrel 3 and a handle 4 having a starting device for connection to a source of compressed air, the handle being connected to the barrel by means of a thread or by any other appropriate known manner. The starting device and compressed air source are not shown and they may be of any appropriate known type. The barrel 3 has an interior space 5 which is hereinafter referred to as the interior, and in this interior is accommodated a piston 6 which is slidingly sealed with its surface 7 against the inner surface 8 of the barrel 3, the piston having an upper control edge 9 and a lower control edge 10.

An end plate 11 is installed between the barrel 3 and the handle 4 so as to define the interior 5 at the top and in this end plate an air distribution device 12 is arranged (this device is shown in a conventional manner and it may be of any appropriate known type; the passages for connecting this device with the interior 5 are not shown either). The air distribution device communicates with a compressed air source through a passage 13 in the handle 4. The device 12 is designed for causing the piston 6 to reciprocate and to deliver blows at the working tool 2.

The barrel 3 has an exhaust passage 14 which consists of an axial passage 15 and a port 16 open into the interior 5 of the barrel 3 and a radial passage 17 with an annular space 18 defined between the barrel 3, handle 4 and manifold 19. The space 18 communicates with atmosphere through a port 20. The port 16 defines, with the inner surface 8 of the barrel 3, an upper control edge 21 and a lower control edge 22. The exhaust passage 14 has a length $L_1$ as measured between the port 16 and the passage 17.

A chamber 23 is defined between the handle 14 and the end plate 11. The chamber 23 communicates with the interior 5 of the barrel 3 through an exhaust passage 24. The passage 24 consists of an axial passage 25 of the end plate 11 and an axial passage 26 of the barrel 3, and a port 27 open into the interior 5 of the barrel 3. The port 27 defines with the inner surface 8 of the barrel 3 an upper control edge 28 and a lower control edge 29. The upper control edge 28 of the port 27 is located above the upper control edge 21 of the port 16 at a distance $S_1$. The lower control edge 29 of the port 27 is located below the control edge 22 of the port 16 at a distance $S_2$. The passage 24 has a length $L_2$ as measured between the port 27 and the upper end face of the end plate 11. A non-return valve 30 with a spring 31 is provided in the passage 24 for allowing a free passage of exhaust air from the interior 5 of the barrel 3 to the chamber 23 and for hampering backward overflow of the air. The chamber 23 is designed for preliminarily reducing the exhaust pressure.

The chamber 23 also communicates with the exhaust passage 14 through a passage 32 defined by an axial passage 33 of the end plate 11 and an axial passage 34 of the barrel 3. The passage 32 communicates with the exhaust passage 14 in the zone of the passage 17. The distance between the outlets from the passages 32 and 24 into the chamber 23 is equal to $L_3$. The length of the passage 32 as measured from the upper end face of the end plate 11 to the passage 17 is equal to $L_4$. The position of the ports 16 and 27 of the exhaust passages 14, 24, respectively, and the point of location of the passage 17 will be described in greater detail in connection with the description of operation of the pneumatic impact tool.

Figure 2:
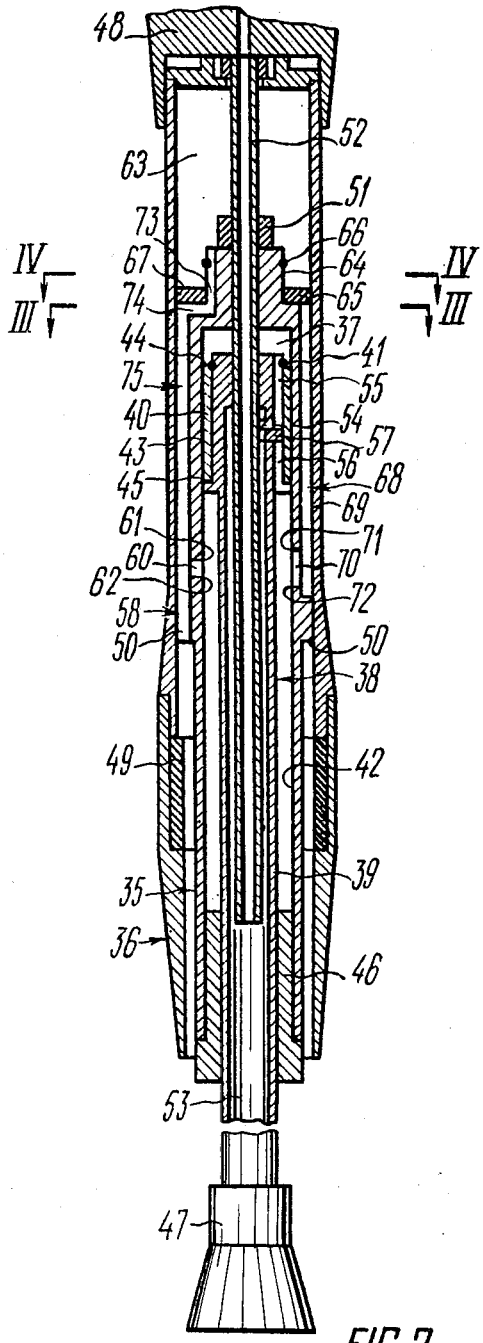

A pneumatic impact tool made as a portable tamper shown in FIG. 2 has a casing 35 on which is installed a housing 36.

The casing 35 has an interior 37 in which a piston 38 is mounted for movement. The piston 38 has a piston rod 39. A liner 40 is installed on the piston 38 and is held against axial movement by an expansion ring 41. The liner 40 is slidingly sealed against the inner surface 42 of the casing 35 with its outer surface 43 which has an upper control edge 44 and a lower control edge 45. The piston rod 39 of the piston 38 is sealed in the barrel by means of a sealing bushing 46 and has a tamping shoe 47 at its end.

The casing 35 is connected to a handle 48 incorporating a starting device for connection to a compressed air source (they are not shown and may be of any appropriate known type).

A shock-absorber 49 made of an elastic material is provided in the casing 35 for limiting the downward movement of the casing 35 when the shock-absorber engages a shoulder 50 of the casing 35. For limiting the upward movement of the casing 35, a shock-absorber 51 is installed at its upper end, which is also made of an elastic material.

A tube 52 is pivotally fixed in the handle 48 and extends inside the interior 37 of the casing 35 and through the piston rod 39 and piston 38. The piston rod 39 has an interior 53 for receiving compressed air. A transverse (radial) groove 54 is made in the upper portion of the piston 38, which communicates with the interior 53 of the piston rod 39. The groove 54 communicates through a passage 55 with the part of the interior space 37 located above the piston 38 and through a passage 56 with the part of the same interior space located below the piston 38. A valve 57 is installed in the groove 54 for an axial movement, which is designed for alternately opening and closing the passages 55, 56 for alternately supplying compressed air to the space above and below the piston 38, respectively, for imparting reciprocations to the piston.

For discharging exhaust air from the interior 37, there are provided exhaust passages 58 which are defined by longitudinal grooves 59 in the casing 35 and the inner surface of the housing 36. The passages 58 communicate with atmosphere through an annular space between the shock-absorber, casing 35 and housing 36. The passages 58 are open into the interior 37 through their ports 60 defining upper control edges 61 and lower control edges 62 at their intersections with the inner surface of the casing 35.

A chamber 63 designed for preliminarily reducing the exhaust pressure is defined between the casing 35 and housing 36, at their top parts.

The upper portion of the casing 35 has a step 64 of a small diameter. On the step 64 is installed a valve member 65 which is mounted for a limited movement. The movement is limited by an expansion ring 66. The valve member 65 is made of an antifriction material in the form of a flat ring also shown at 65. The ring 65 intimately engages with its lower side the end face 67 of the casing 35 which forms a seat for the valve member 65 and which has a larger diameter.

There are provided passages 68 (FIG. 2) defined by longitudinal grooves 69 (FIG. 2) of the casing 35 and the inner surface of the housing 36. At one end the passages 68 terminate in the end face 67 of the casing 35 and at the opposite end they have ports 70 opening into the interior 37. The ports 70 define with the inner surface of the casing 35 an upper control edge 71 and a lower control edge 72. The upper control edge 71 of the port 70 is located above the upper control edge 61 of the port 60. The lower control edge 72 of the port 70 is located below the lower control edge 62 of the port 60.

Longitudinal grooves 73 are provided in the step 64 of the casing 35 and communicate with grooves 74 which, in turn, communicate with the grooves 59.

A combination of the grooves 73 (FIG. 4), 74 (FIG. 2), 59 form passages 75 for putting the chamber 63 in communication with the ports 60.

A combination of the flat ring 65 installed on the step 64 of the casing 35 and the end face 67 of the large-diameter step of the casing 35 forming a seat define a non-return valve which allows a free passage of exhaust air from the interior 37 of the casing 35 into the chamber 63 and hampers its backward flow. This non-return valve allows a free passage of exhaust air from the chamber 63 into the passage 75.

The position of the control edges 71, 72 with respect to the control edges 61, 62 and the lengths of the passages 58, 68, 75 are chosen similarly to the position of the edges 28, 29, 21, 22 and passages 14, 24, 32 as described above.

The pneumatic impact tool shown in FIG. 1 functions in the following manner.

When the starting device is turned on, compressed air is supplied from a source through a passage 13 in the handle 4 to the air distribution device 12. The air distribution device 12 causes, in any conventional method, the piston 16 to reciprocate by alternately supplying portions of compressed air into the interior space 5 under the piston and into the interior space 5 above the piston 6. As a result of these movements, the piston 6 delivers blows on the working tool 2, thereby performing a useful work.

From the position shown in FIG. 1, the piston 6 moves upward. After the lower edge 10 of the piston 6 passes by the lower edge 29 of the port 27, the exhaust air from the interior 5 under the piston starts flowing up through the passage 24. The non-return valve 30 opens to allow the passage of the exhaust air into the chamber 23 from which the air flows through the passage 32 toward the passage 17.

The compressed air pressure in the interior 5 of the casing 1 starts decreasing owing to the connection thereto of the chamber 23. After the lower edge 10 of the piston 6 passes by the lower edge 22 of the port 16, exhaust air discharge begins from the space of the interior 5 located under the piston 6. The exhaust air flows through the exhaust passage 14 and arrives at the passage 17 substantially simultaneously with the arrival of the exhaust air coming from the chamber 23 through the passage 32. At the point of merger of these passages an intense stirring of the two flows occurs thus reducing the turbulence of the exhaust air emerging from the passage 17 thereby lowering the aerodynamic noise.

After the piston 6 has uncovered the port 16 of the exhaust passage 14, pressure of compressed air in the passage 24 becomes lower than the pressure in the chamber 23 so that the non-return valve 30 is closed so seal-off the chamber 23 with respect to the interior 5 of the casing 1. This hampers the flow of exhaust air from the chamber 23 back to the interior 5 of the casing 1.

When the piston 6 moves downward, the above described processes are repeated upon cooperation of the upper edge 9 of the piston with the upper edge 28 of the port 27 of the passage 24 and upper edge 21 of the port 16 of the exhaust passage 14.

The noise reduction is achieved owing to a lower turbulence of exhaust air emerging from the tool which is obtained by splitting the flow of exhaust air into two flows, with their subsequent merger.

The effect of lowering the aerodynamic noise is improved by a clearcut splitting of the exhaust air flow into two flows owing to the provision of the non-return valve 30.

In addition, the effectiveness of lowering the aerodynamic noise of the tool is achieved owing to the fact that both abovementioned flows actively participate in the merger which is achieved by their simultaneous arrival at the passage 17. This is provided by a predetermined dimensional proportioning of the tool, namely, by compliance with the following relationships:

$$\frac{L_2 + L_3 + L_4}{V_1} = \frac{S_2}{V_2} + \frac{L_1}{V_1},$$

$$\frac{L_2 + L_3 + L_4}{V_1} = \frac{S_1}{V_3} + \frac{L_1}{V_1},$$

wherein $L_1$, $L_2$, $L_3$, $L_4$, $S_1$, $S_2$ are the abovementioned values;

$V_1$ is the velocity of the exhaust air;

$V_2$ is the speed of the piston 6 when it moves upward;

$V_3$ is the speed of the piston 6 when it moves downward.

As $V_1$ is a known value, and $V_2$ and $V_3$ are determined by the concrete design of the tool, the abovementioned conditions may be easily fulfiled by varying the dimensions $L_1$, $L_2$, $L_3$, $L_4$, $S_2$, $S_1$.

Figure 4:
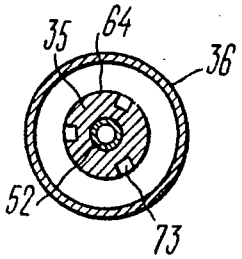
FIG. 4 is a sectional view taken along the line IV—IV in FIG. 2.
Figure 3:
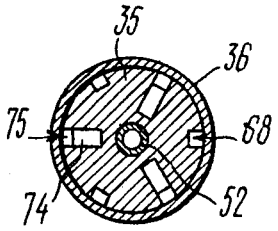
FIG. 3 is a sectional view taken along the line III—III in FIG. 2.

The pneumatic impact tool shown in FIGS. 2 through 4 functions in the following manner.

In a starting position shown in FIG. 2 the piston 38 is in the uppermost position in the interior 37 of the casing 35. The valve 57 is in the lower position and shuts-off the passage 56 connecting the groove 54 to the space of the interior 37 located under the piston 38 which, via the exhaust passages 58 and the space between the casing 35 and housing 36, communicates with atmosphere. The space of the interior 37 located above the piston 38 communicates with the space 53 through the passage 55 and groove 54. The casing 35 is in a certain intermediate position with respect to the housing 36. The valve member 65 is in its lower position in which it shuts-off the passages 68. The chamber 63 communicates with atmosphere through the passages 75.

When the starting device in the handle 48 is turned on, compressed air through the tube 52 is admitted to the space 53 in which the pressure remains substantially unchanged during subsequent operation.

Compressed air flows from the space 53 through the groove 54 and passage 55 to the space of the interior 37 located above the piston 38, whereby the piston 38 starts moving downward and the casing 35 starts moving upward.

After the upper edge 44 of the piston 38 has passed by the upper edges 71 of the ports 70, compressed air starts flowing from the space of the interior 37 located above the piston 38 through the passages 68 upward toward the chamber 63. As the pressure in the chamber 63 is equal to atmospheric pressure owing to the communication of this chamber with atmosphere through the passages 75, the valve member 65 is caused to move to its upper position by the greater pressure forces applied from below. The passages 68 are thus open, and the exhaust air starts filling the chamber 63 and flows therefrom through the passages 75 toward the port 60.

By the moment when the upper edge 44 of the piston 38 passes by the upper edge 61 of the port 60 the pressure of compressed air in the space of the interior 37 located above the piston will drop because of connection of the chamber 63 to this space. The exhaust pressure reduction thus contributes to lowering of the aerodynamic noise.

After the upper edge 44 of the piston 38 has passed by the upper edges 61 of the ports 60, the discharge of exhaust air begins from the space of the interior 37 located above the piston 38. The pressure of compressed air in this space and in the passages 68 will drop suddenly and will become lower than that in the chamber 63. As a result the valve member 65 is caused to move to its lower position to shut-off the passages 68 thus preventing the backward flow from the chamber 63 into the interior 37.

Approximately at the same time, the exhaust air from the chamber 63 flows through the passages 75 and from the space of the interior 37 located above the piston 38 arrive at the ports 60 where an intense merger of the two flows occurs thus contributing to a reduction of the turbulence of the general flow of the exhaust air emerging into atmosphere through the annular space between the casing 35 and housing 36, thereby lowering the aerodynamic noise.

After the exhaust cycle is over, the pressure in the space of the interior 37 located above the piston 38 becomes about equal to the atmospheric pressure, and the pressure in the space of the interior 37 located under the piston 38 increases owing to a compression of the air trapped therein. Under the action of the greater pressure forces applied from below the valve 57 is caused to move to its upper position so as to direct a flow of compressed air into the space of the interior 37 located under the piston 38. Approximately at the same time, the piston 38, together with the piston rod 39 and tamping shoe 47, delivers a blow at the material being compacted thereby performing a useful work. The piston will then start moving upward. The casing 35 will be braked approximately at the same time and will then start moving downward.

When the piston 38 moves upward and the casing 35 downward, the abovedescribed processes are repeated.

Further reduction of the tool noise is explained by the same phenomena as those described above for the embodiment shown in FIG. 1.

During operation the casing 35 oscillates about a certain intermediate point without axially engaging parts of the housing 36. The shock-absorbers are only designed for damping accidental collisions of the casing and housing. Vibrations of the housing 36 are minimized as a substantially constant force is applied to the housing through the tube 52 on the side of the space 53 because this force is determined by a substantially unchanged pressure of compressed air. A certain reduction of compressed air pressure in the space 53 at the moments of exhaust and oscillations of the abovementioned constant force are compensated for by feeding exhaust air to the chamber 63 substantially at the same moments.

When the exhaust air passes through the passages 68, 75 and 58, an air lubrication is provided between the surfaces of the casing 35 and housing 36 thus reducing vibrations of the housing 36 which otherwise might be stronger owing to the friction with the casing 35 when the latter reciprocates.

Experimental pneumatic impact tampers for foundry use have been made according to the invention and tested. The tests conducted with the tampers showed that the aerodynamic noise was 4–6 dB lower compared to the existing conventional tampers used for the same purposes. The new tampers had minimum vibrations which were almost imperceptible for operator. In addition, the tampers are simple in structure, comparatively lightweight and smaller in size.

We claim:

1. A pneumatic impact tool comprising:
   - a casing having an inner surface;
   - an interior space of said casing;
   - a piston arranged in said space of the casing and adapted to reciprocate under the action of compressed air for delivering useful blows;
   - at least one first port in said casing communicating with the interior space of the casing, and defining an upper and a lower control edge with the inner surface thereof;
   - at least one second port in the casing, communicating with the interior space of the casing and defining with the inner surface thereof an upper and a lower control edge located above and below the respective edge of the first port;
   - a first passage communicating with the first port and with the atmosphere and intended for discharging exhaust air from the internal space of the casing;
   - a second passage communicating with the second port;
   - a chamber communicating with the second passage and intended for preliminary reduction of pressure at an outlet, said chamber being disposed between an upper end of the casing and a housing;

a third passage communicating with the first port and with the chamber for preliminary reduction of pressure at the outlet; and a non-return valve provided in the second passage and intended for freely passing the air from the interior space of the casing through said second port to the chamber for preliminary reduction of pressure at the outlet and preventing the back flow thereof.

2. The pneumatic impact tool of claim 1 wherein the casing is provided in the upper part thereof with a step, the diameter of which is smaller than the diameter of a casing step adjoining the housing and which extends into the chamber for preliminary reduction of pressure at the outlet, and the non-return valve is formed by a flat ring mounted on the small-diameter step of the casing to perform limited axial movement, and the end surface between said casing steps, with the second passage, which communicates through the second port with the internal space of the casing, terminating at said end surface.

* * * * *